US006042394A

United States Patent [19]

Mitra et al.

[11] Patent Number: 6,042,394

[45] Date of Patent: Mar. 28, 2000

[54] RIGHT-ANGLE CONNECTOR

[75] Inventors: Niranjan Mitra, GH Eindhoven; Bernardus L. F. Paagman, Schijndel, both of Netherlands

[73] Assignee: Berg Technology, Inc., Reno, Nev.

[21] Appl. No.: 08/930,375

[22] PCT Filed: Apr. 17, 1996

[86] PCT No.: PCT/US96/05364

§ 371 Date: Sep. 29, 1997

§ 102(e) Date: Sep. 29, 1997

[87] PCT Pub. No.: WO96/33531

PCT Pub. Date: Oct. 24, 1996

[30] Foreign Application Priority Data

Apr. 19, 1995 [EP] European Pat. Off. ..... 95201004

[51] Int. Cl.[7] ..... H01R 9/09

[52] U.S. Cl. ..... 439/80; 439/608

[58] Field of Search ..... 439/80, 108, 79, 439/608

[56] References Cited

U.S. PATENT DOCUMENTS 4,329,008 5/1982 Braginetz ..... 439/80

4,846,727 7/1989 Glover et al. ..... 439/108

*Primary Examiner*—Steven L. Stephan

*Assistant Examiner*—Javaid Nasri

*Attorney, Agent, or Firm*—Daniel J. Long; M. Richard Page

[57] ABSTRACT

Connector comprising a housing (3), at least one contact element provided with a first contact portion (21) for mating contact to another contact element of another connector and a pcb contact portion (17; 28) for contacting a pcb or the like wherein the connector is divided into at least a main-receptacle unit (1) and a tail-unit (2), the main-receptacle unit (1) comprising at least one adapting unit (24) provided with an adapting contact member (15) connected to said first contact portion (21) and to a second contact portion (22; 22') and the tail-unit (2) comprising at least one tail contact element (19; 27) connected to said pcb contact portion (17; 28) and to a third contact portion (20; 30), said third contact portion (20; 30) being arranged for mating contact with said second contact portion (22; 22').

5 Claims, 3 Drawing Sheets

RIGHT-ANGLE CONNECTOR

BACKGROUND OF THE INVENTION

The present invention relates to connectors comprising a housing into which at least part of the contact elements is to be inserted during manufacturing. The invention is best explained by referring to FIG. 1 showing a prior art right-angle connector.

In FIG. 1 a connector comprising a main-receptacle unit 1 and a tail-unit 2 are shown. The main-receptacle unit 1 comprises openings 4 within a housing 3 for accommodating a contact portion 5 of a contact element. The contact portion 5 is integrally made with a tail-conductor portion 6 and a pcb (printed circuit board) contact portion 7. Each contact portion 5 is shown to be of a female-type preloaded with a pre-load rib 10. The housing 3 is provided with a guiding member 9 to facilitate the insertion of another mating connector (not shown) to the main-receptacle unit 1. A fixing pin 8 is provided on the housing 3 for cooperation with a suitable opening in a printed circuit board (not shown) to which the right-angle connector is to be connected. It is to be understand that the phrase "printed circuit board" is used in a very broad sense and incorporates any substrate to which the connector is to be connected and which is provided with suitable conducting tracks.

The pcb contact portions 7 are shown to be suitable for through-mounting to a pcb, however, they can be provided in a form suitable for surface mounting, press-fit mounting or IDC.

In the prior art, the tail-unit 2 is provided with suitable openings for receiving each of the tail-conductor portions 6. Each of the tail-conductor portions 6 need be individually bent after insertion in the tail-unit 2 and be collected and held together by a separate press-block or waver. For high operating frequencies (clock-speed lower than 1 nanosecond), an increase in the cross-talk and reflection of signals result to deteriorate the signal integrity. This is partially due to the relatively long (and varying) tail length and also to the absence of adequate electrical shielding between adjacent tail-conductor portions 6 arranged in rows and columns. Moreover, the bending of individual rows of tail-conductor portions 6 is difficult and often results in reduced productivity.

Especially for high operating frequencies shielding between adjacent contact portions 5 and adjacent tail-conductor portions 6 will be required. A coaxial connector module provided with shield members to shield adjacent tail-conductor portions in a right-angle configuration is, e.g., described in European patent application 0,488,482 of the present applicant. In this prior art connector separate shield members made of thin, suitably folded metallic plates are provided which are inserted into the housing of the tail-unit. Although solving the problems of cross-talk manufacturing costs of such connectors are still high.

The object of the present invention is to provide a connector which can be easily made at relatively low costs and which is suitable for connector to a printed circuit board or the like at any predetermined angle.

A further object of the present invention is to provide such a connector in which shielding of each of the tail-conductor portions can also easily be provided at low costs.

SUMMARY OF THE INVENTION

A connector according to the invention comprises a housing, at least one contact element provided with a first contact portion for mating contact to another contact element of another connector and a pcb contact portion for contacting a pcb or the like, characterized in that the connector is divided into at least a main receptacle unit and a tail-unit, the main receptacle-unit comprising at least one adapting unit provided with an adapting contact member connected to said first contact portion and to a second contact portion and the tail-unit comprising at least one tail contact element connected to said pcb contact portion and to a third contact portion, said third contact portion being arranged for mating contact with said second contact portion.

By separating the connector into a main-receptacle-unit and a tail-unit, which are connectable and disconnectable from one another the possibility of converting a connector from straight to right-angle configurations, or changing from through-mount to press-fit connection to a pcb can be provided. Moreover, the difficulty of forming right-angle bending of connector row structures of terminals, can be avoided.

In a first embodiment the or each tail contact element of the tail-unit is made of a dual-beam contact with a female-type third contact portion. The advantage of this embodiment is that the dual-beam contacts can be made of a material suitable to have a press-fit pcb contact portion.

In the first embodiment the or each dual-beam contact may be provided with a suitable shielding.

In a second embodiment according to the invention the or each tail contact element is made of semi-rigid cable comprising an inner conductor integrally made with said third contact portion and said pcb contact portion, and an outer conductor for shielding said inner conductor and for mating contact with a shielding on a mating adapting unit. Semi-rigid cables are available from many manufacturers and need no special adaptations to be used in the tail-unit of the present invention. They can be easily bent a predetermined angle without deteriorating the impedance. Therefore, they are very suitable for preventing cross-talk and reflection of signals within the connector. No separate shielding plates with which impedance requirements cannot easily be met are required.

The invention is also directed to a tail-unit comprising at least one tail contact element connected to a pcb contact portion and to a third contact portion, said third contact portion being arranged for mating contact with said second contact portion arranged within said main-receptacle unit of the connector, as defined above, the or each tail contact element being made of a dual-beam contact with a female-type third contact portion.

Moreover, the invention is directed to a tail-unit comprising at least one tail contact element connected to said pcb contact portion and to a third contact portion, said third contact portion being arranged for mating contact with said second contact portion arranged within said main-receptacle unit of the connector according to claim 1, the or each tail contact element being made of semi-rigid cable, comprising an inner conductor integrally made with said third contact portion and said pcb contact portion, and an outer conductor for shielding said inner conductor and for mating contact with a shielding and a mating adapting unit.

BRIEF DESCRIPTION OF DRAWINGS

The invention will be explained below in more detail. It is to be understood that the figures shown in the drawings are only meant to illustrate the invention and not to limit its scope.

FIG. 2*a* shows a connector according to the invention which is divided into a separate main-receptacle unit 1 and a tail-unit 2. The same reference numbers in FIG. 2*a* refer to the same parts and elements of the connector shown in FIG. 1.

DETAILED DESCRIPTION OF THE PREFERRED EMBODIMENT

Figure 1:
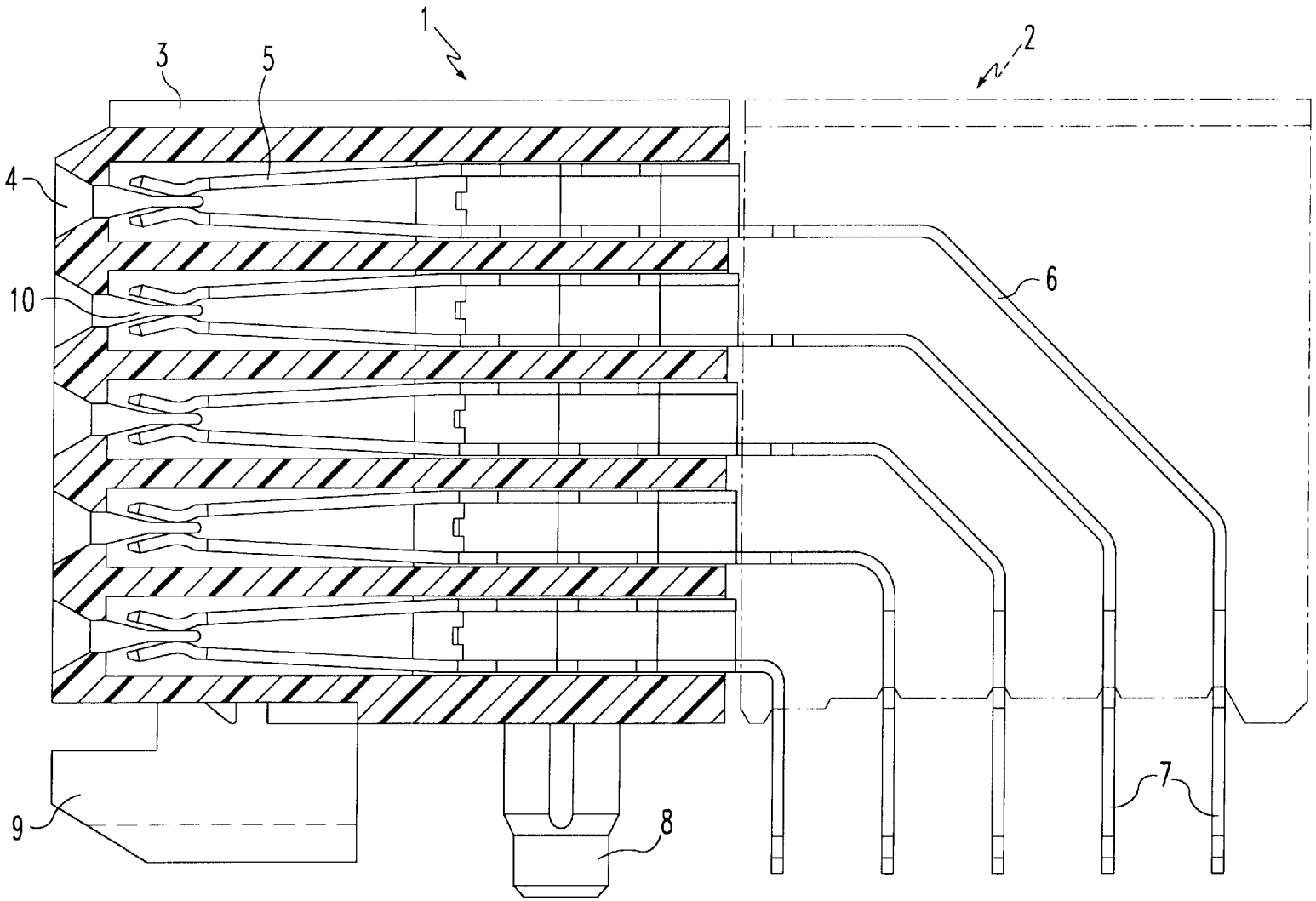
FIG. 1 shows a right angle connector according to the prior art.
Figure 2B:
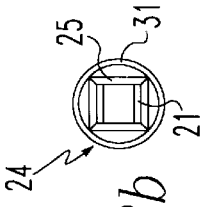
FIGS. 2*a*, 2*b*, and 3 show two right angle connectors according to the invention.
Figure 2A:
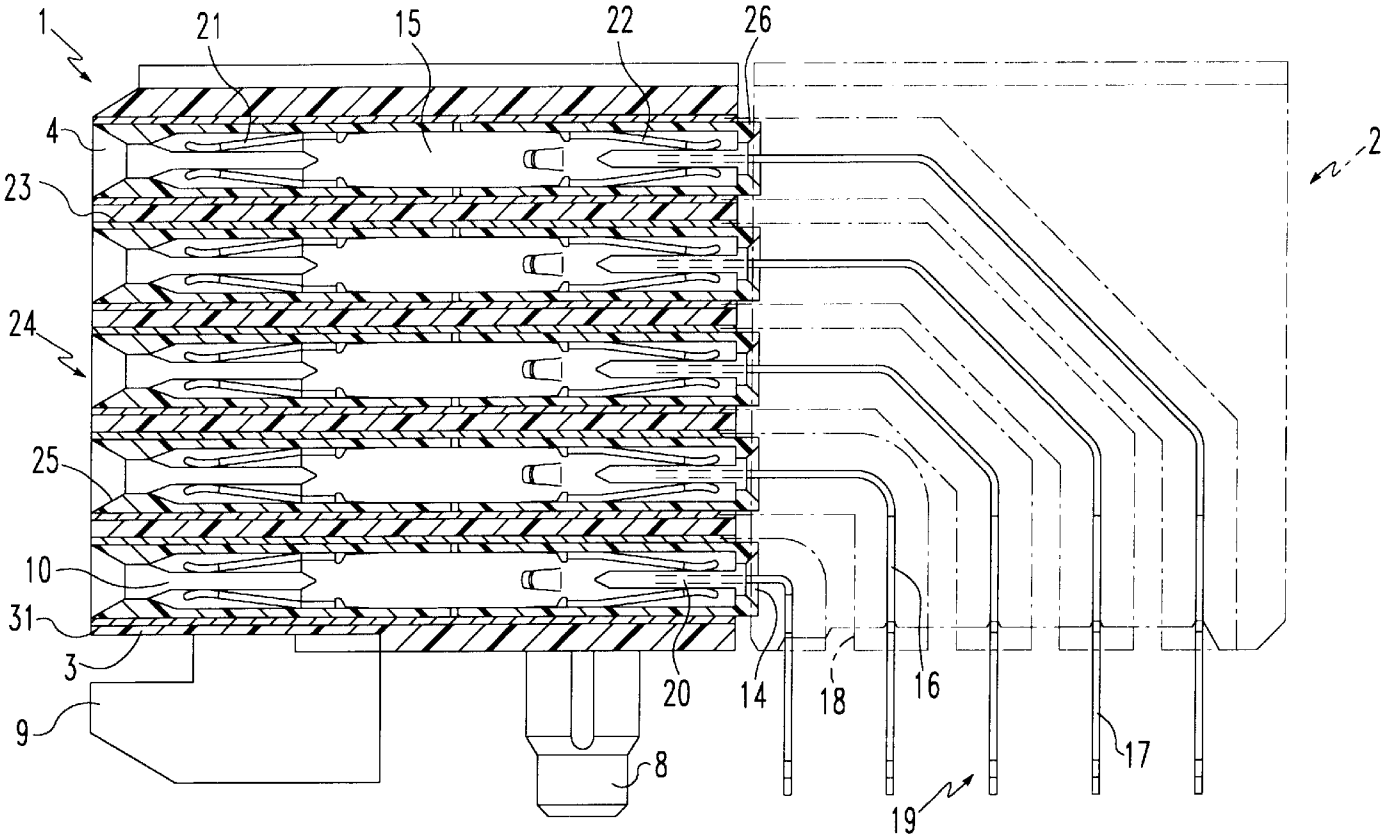

Referring to FIGS. 2*a* and 2*b*, the main-receptacle unit 1 comprises separate adapting units 24 inserted into suitable openings 23 in the housing 3. Each of the adapting units 24 is, preferably, provided with a suitable shielding layer 31 at its outer surface for shielding an adapting contact member 15 provided within the housing 25 of the adapting unit 24. Instead of a metallic layer 31 on housing 25 a metal cylindrical sleeve 31, into which housing 25 is to be inserted, can be provided, as shown in FIG. 2*b*.

Preferably, each of the adapting contact members 15 is integrally made with a first contact portion 21 and a second contact portion 22. In the embodiment shown in FIG. 2*a* both the first and the second contact portions 21, 22 are shown to be of a female type. However, the present invention is not restricted to such a type of contact portion. A male-type or hermaphrodite type of contact portion may be provided instead, as is known to any person skilled in the art.

The tail-unit 2 comprises several tail contact elements 19, preferably made of semi-rigid cables. Semi-rigid cables are known to persons skilled in the art. Each of the semi-rigid cables 19 is provided with an inner conductor 16 integrally made with a third contact portion 20 for suitable contact with a second contact portion 22, and a pcb contact portion 17. The pcb contact portion 17 is suitable for through-mount connection to a printed circuit board or the like. However, a surface mount connection or IDC may be provided instead. Each of the inner conductors 16 is surrounded by an outer conductor 18 for shielding the inner conductor 16.

Each of the adapting units 24 is designed to have an extending portion 26 to be received by the end of an outer conductor 18 of a mating rigid cable 19. Any third contact portion 20 is, in use, inserted into a second contact portion 22. Any of the third contact portions 20 may be reinforced by soldering to a suitable contact pin to be inserted into the mating second contact portion 22. Instead, the third contact portions may be soldered to suitable female-type contact portions (not shown) when the second contact portions 22 are male-type (not shown).

The semi-rigid cables 19 are grouped together within a single housing which need no separate channels for accommodating separate tail conductors. The manufacturing tolerances of a tail-unit provided with semi-rigid cables 19 are relatively large. No ideal bending is required to meet impedance requirements or to avoid deteriorating reflections.

FIG. 2*b* shows a front view of an adapting unit 24. The shielding 31 is provided as a cylindrical sleeve. The other reference numbers have already been explained when describing FIG. 2*a*.

Figure 3:
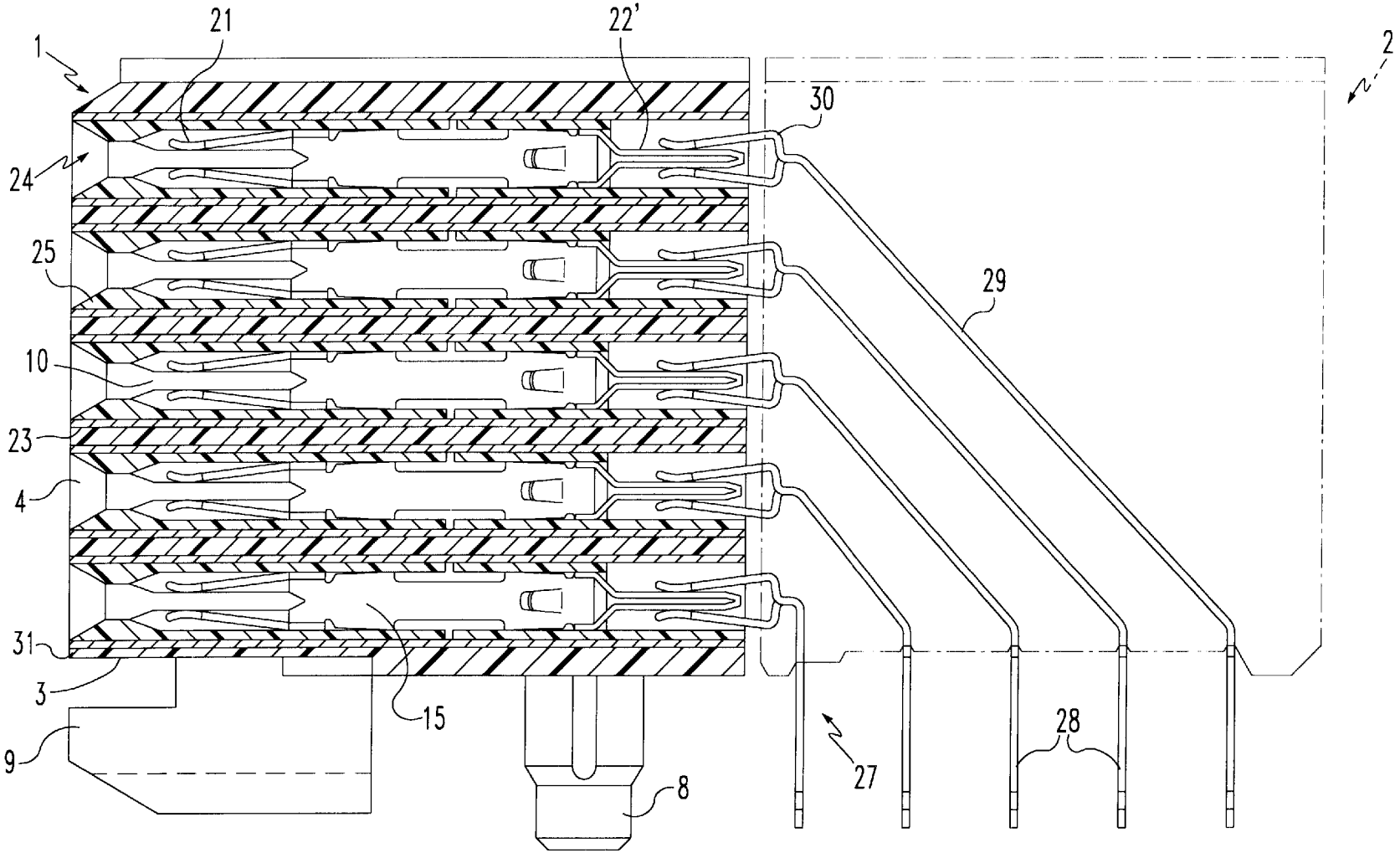

FIG. 3 shows a further embodiment of the present invention. In FIG. 3 the tail-unit 2 is provided with dual-beam contacts 27 comprising a dual-beam contact conductor 29, preferably made integrally with female-type contacts 30 and pcb contact portions 28. Such dual-beam contacts can easily be made of a material suitable to have a press-fit pcb contact portion 28 which is more difficult to achieve with the pcb contact portions 17 of the semi-rigid cable embodiment according to FIGS. 2*a* and 2*b*.

Each of the female contacts 30 can be connected to a suitable male-type second contact portion 22' of adapting contact member 15.

Preferably, each of the dual-beam contacts 27 are provided with suitable shieldings surrounding plastic housings accommodating said individual dual-beam contacts.

Again, instead of press-fit pcb contact portions 28 contact portions suitable for surface mounting, through-mounting or IDC may also be provided.

When no shielding for the tail-unit is required (e.g. when no high frequencies are used) the application of a separate tail-unit 2, as shown in FIG. 3, may still have several advantages, such as the possibility of converting a connector from straight to righ-tangle configurations or changing from through-mount to press-fit connecting means to a printed circuit board. Moreover, the application of dual-beam contacts 27 without shielding still avoids the difficulty of forming right-angle bending of connector row structures as described above.

The invention is not restricted to the application of either semi-rigid cables or dual-beam contacts within a tail-unit as described above. For instance, mini coax-cables can be used instead of semi-rigid cables in a tail-unit 2.

What is claimed is:

1. A connector which includes a housing (3), at least one contact element provided with a first contact portion (21) for mating contact to another contact element of another connector and a pcb contact portion (17; 28) for contacting a pcb characterized in that the connector is divided into at least a main receptacle unit (1) and a tail-unit (2), the main receptacle unit (1) includes at least one adapting unit (24) provided with an adapting contact member (15) connected to said first contact portion (21) and to a second contact portion (22; 22'), the tail unit (2) includes at least one tail contact element (19; 27) connected to said pcb contact portion (17; 28) and to a third contact portion (20; 30), said third contact portion (20; 30) which is arranged for mating contact with said second contact portion (22; 22'), and the tail-unit is comprised of at least one tail contact element (27) connected to a pcb contact portion (28) and to a third contact portion (30), and said third contact portion (30) is arranged for mating contact with said second contact portion (22') within said main-receptacle unit (1) and each tail contact element (27) is comprised of a dual beam contact with said third contact portion (30).

2. The connector according to claim 1 characterized in the tail contact element is made of semi-rigid cable (19) comprising an inner conductor (16) integrally made with said third contact portion (20) and said pcb contact portion (17), and an outer conductor (18) for shielding said inner conductor (16) and for mating contact with a shielding (31) on a mating adapting unit (24).

3. A connector according to claim 1, characterized in that each tail contact (19; 27) is bent to a predetermined angle necessary to make contact with the pcb.

4. The connector according to claim 3, characterized in that said predetermined angle is substantially x/2.

5. A connector which includes a housing (3), at least one contact element provided with a first contact portion (21) for mating contact to another contact element of another connector and a pcb contact portion (17; 28) for contacting a pcb characterized in that the connector is divided into at least a main receptacle unit (1) and a tail-unit (2), the main receptacle unit (1) includes at least one adapting unit (24) provided with an adapting contact member (15) connected to said first contact portion (21) and to a second contact portion (22; 22'), the tail unit (2) includes at least one tail contact element (19; 27) connected to said PCB contact portion (17; 28) and to a third contact portion (20; 30), said third contact portion (20; 30) which is arranged for mating contact with said second contact portion (22; 22'), and the tail-unit (2) is comprised of at least one tail contact element (19) connected to said pcb contact portion (17) and to a third contact portion (20), said third contact portion being arranged for making contact with said second contact (22) arranged within said main-receptacle unit (1), and each tail contact element is comprised of a semi-rigid cable (19) comprised of an inner conductor (16) integrally made with said third contact portion (20) and said pcb contact portion (17), and an outer conductor (18) for shielding said inner conductor and for making contact with a shielding (31) on said mating adapting unit (24).

* * * * *